US008316833B2

(12) United States Patent
Chen

(10) Patent No.: US 8,316,833 B2
(45) Date of Patent: Nov. 27, 2012

(54) IGNITION ENHANCER FOR A VEHICLE ENGINE

(76) Inventor: Feng-Kuei Chen, Tainan (TW)

( * ) Notice: Subject to any disclaimer, the term of this patent is extended or adjusted under 35 U.S.C. 154(b) by 868 days.

(21) Appl. No.: 12/464,876

(22) Filed: May 13, 2009

(65) Prior Publication Data

US 2010/0288250 A1 Nov. 18, 2010

(51) Int. Cl.
*F02P 3/06* (2006.01)
*F02P 3/12* (2006.01)

(52) U.S. Cl. ..... 123/596

(58) Field of Classification Search ..... 123/596, 123/605, 601, 647, 653, 169 PA
See application file for complete search history.

(56) References Cited

U.S. PATENT DOCUMENTS 5,370,100 A * 12/1994 Benedikt et al. ..... 123/654

FOREIGN PATENT DOCUMENTS

CN 200952447 Y * 9/2007

* cited by examiner

*Primary Examiner* — Hieu T Vo

(57) ABSTRACT

An ignition enhancer for a vehicle engine is installed between a conducting wire of a high voltage coil and a plug connector, provided with a capacitor, two conducting rods respectively extended outward from two ends of the capacitor, an insulation sleeve wrapping around the capacitor and filled with a waterproof resin to fully surround the capacitor, and two engaging grooves respectively formed in two ends of the insulation sleeve. Thus, with the conducting rods inserted in a core of the conducting wire of the high voltage coil and the plug connector respectively, the capacitor, storing an electric charge, is able to stabilize voltage and fulfill filtering to strengthen ignition power after starting a vehicle engine, not only advancing combustion efficiency to lower carbonization but also augmenting engine power.

5 Claims, 5 Drawing Sheets

IGNITION ENHANCER FOR A VEHICLE ENGINE

BACKGROUND OF THE INVENTION

1. Field of the Invention

This invention relates to an ignition enhancer for a vehicle engine, particularly to one installed between a conducting wire of a high voltage coil and a plug connector and provided with a capacitor storing an electric charge to stabilize voltage and fulfill filtering so as to strengthen ignition power, not only advancing combustion efficiency for lowering carbonization but also augmenting power of a vehicle.

2. Description of the Prior Art

Commonly, a vehicle is started by means of a plug ignited by a high voltage current created by a high voltage coil, so as to keep an engine normally operating. However, as some of the high voltage current coming out of the high voltage coil is always not to act on the plug, the igniting power of the plug is to be weakened to pose not only incomplete combustion, resulting in carbonization of the plug, but also lessening service life of the engine; moreover, with the incomplete combustion, a large quantity of polluting gases may be produced to severely contaminate the air.

SUMMARY OF THE INVENTION

The object of this invention is to offer an ignition enhancer for a vehicle engine. The ignition enhancer can stabilize voltage and fulfill filtering so as to instantly discharge to enlarge electric power, not only strengthening ignition power to advance combustion efficiency for lowering carbonization but also augmenting power of a vehicle engine at the same time.

The ignition enhancer is characteristically installed between a conducting wire of a high voltage coil and a plug connector, provided with a capacitor, two conducting rods respectively extended outward from two ends of the capacitor, an insulation sleeve wrapping around the capacitor and filled with a waterproof resin to fully surround the capacitor, and two engaging grooves respectively formed in two ends of the insulation sleeve.

BRIEF DESCRIPTION OF DRAWINGS

This invention is better understood by referring to the accompanying drawings, wherein.

DETAILED DESCRIPTION OF THE PREFERRED EMBODIMENT

Figure 1:
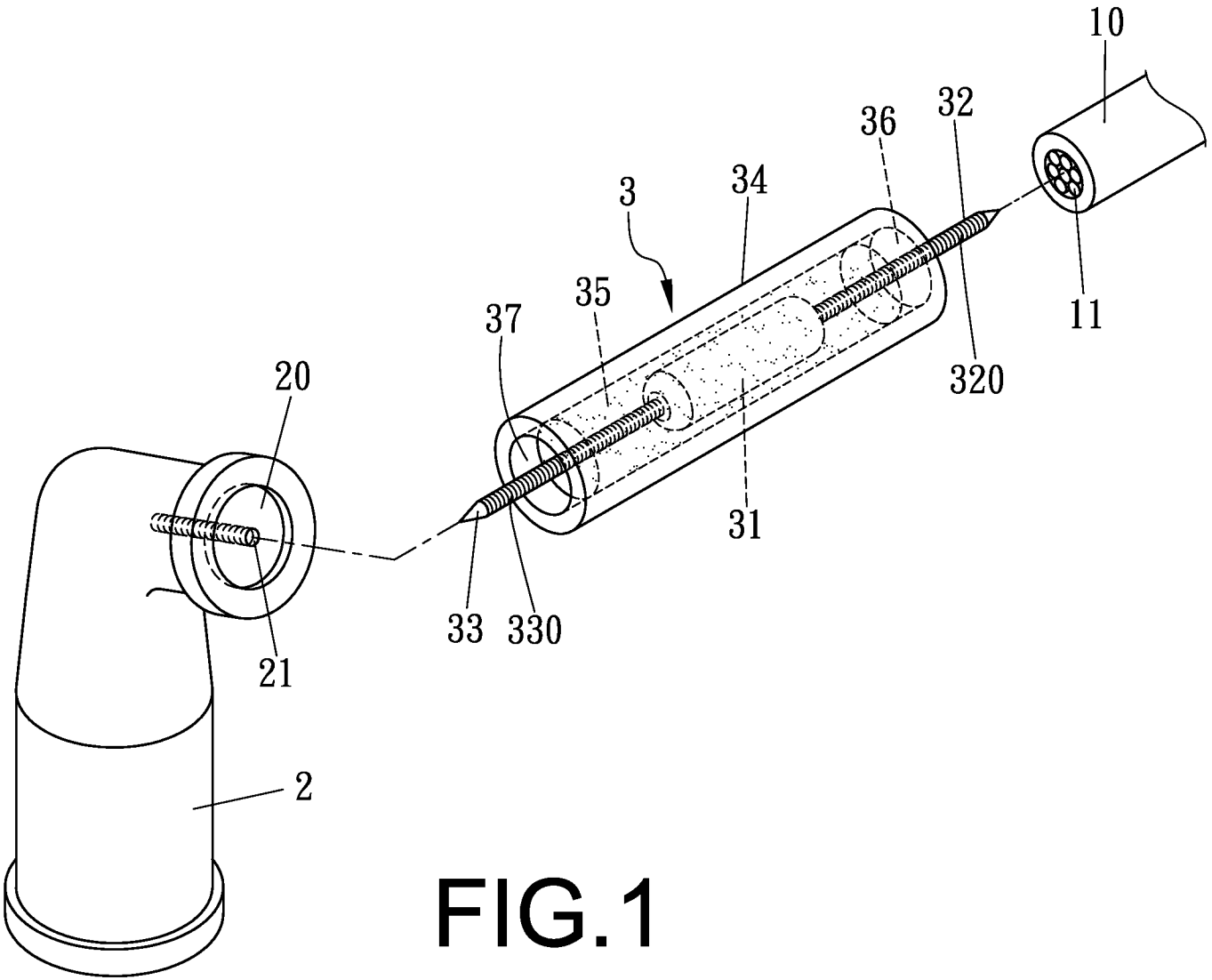
FIG. 1 is an exploded perspective view of a first preferred embodiment of an ignition enhancer for a vehicle engine in the present invention.
Figure 2:
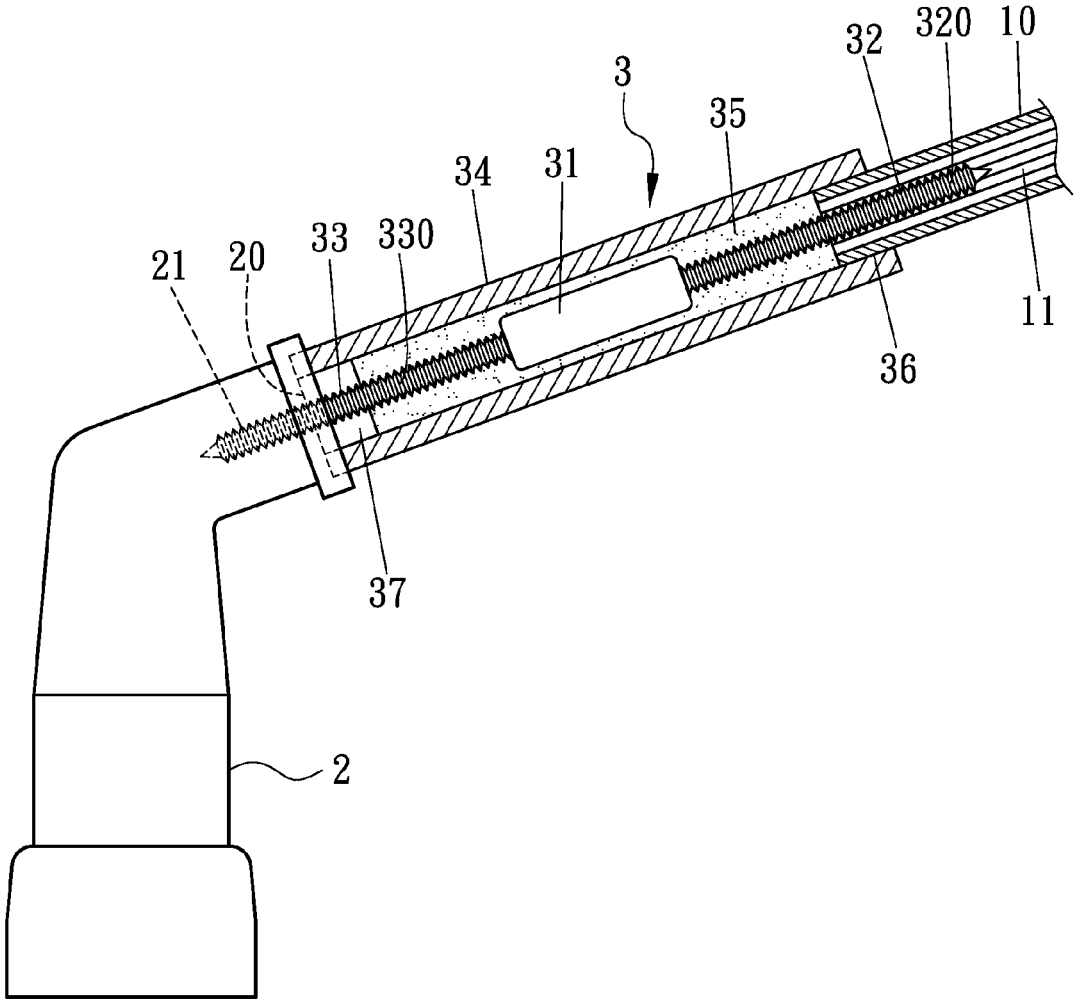
FIG. 2 is a cross-sectional view of the first preferred embodiment of an ignition enhancer for a vehicle engine in the present invention.

FIGS. 1 and 2 show a first preferred embodiment of an ignition enhancer 3 for a vehicle engine in the present invention. The ignition enhancer 3 is installed between a conducting wire 10 of a high voltage coil and a plug connector 2 provided with a groove 20 formed in one end and a female-threaded hole 21 bored inside the groove 20. The ignition enhancer 3 is provided with a capacitor 31, two conducting rods 32 and 33 respectively extended outward from two ends of the capacitor 31, an insulation sleeve 34 wrapping around the capacitor 31 and filled with waterproof resin 35 (Epoxy resin) to fully surround the capacitor 31, and two engaging grooves 36 and 37 respectively formed in two ends of the insulation sleeve 34. Each of the conducting rods 32 and 33 has male threads 320 and 330 formed around the surface respectively.

In assembling, an end of the conducting wire 10 of the high voltage coil is first plugged in the engaging groove 36 of the ignition enhancer 3, with the conducting rod 32 inserted into a core 11 of the conducting wire 10, and the other end of the ignition enhancer 3 is plugged into the groove 20 of the plug 2, with the conducting rod 33 threadably engaging with the female-threaded hole 21. Thus, with the ignition enhancer 3 connected between the conducting wire 10 of the high voltage coil of a vehicle engine and the plug connector 2, the capacitor 31, storing an electric charge, is able to stabilize voltage and fulfill filtering after starting a vehicle engine, not only advancing combustion efficiency to lower carbonization and augment engine power but also lessening emission of polluting gases at the same time.

Figure 3:
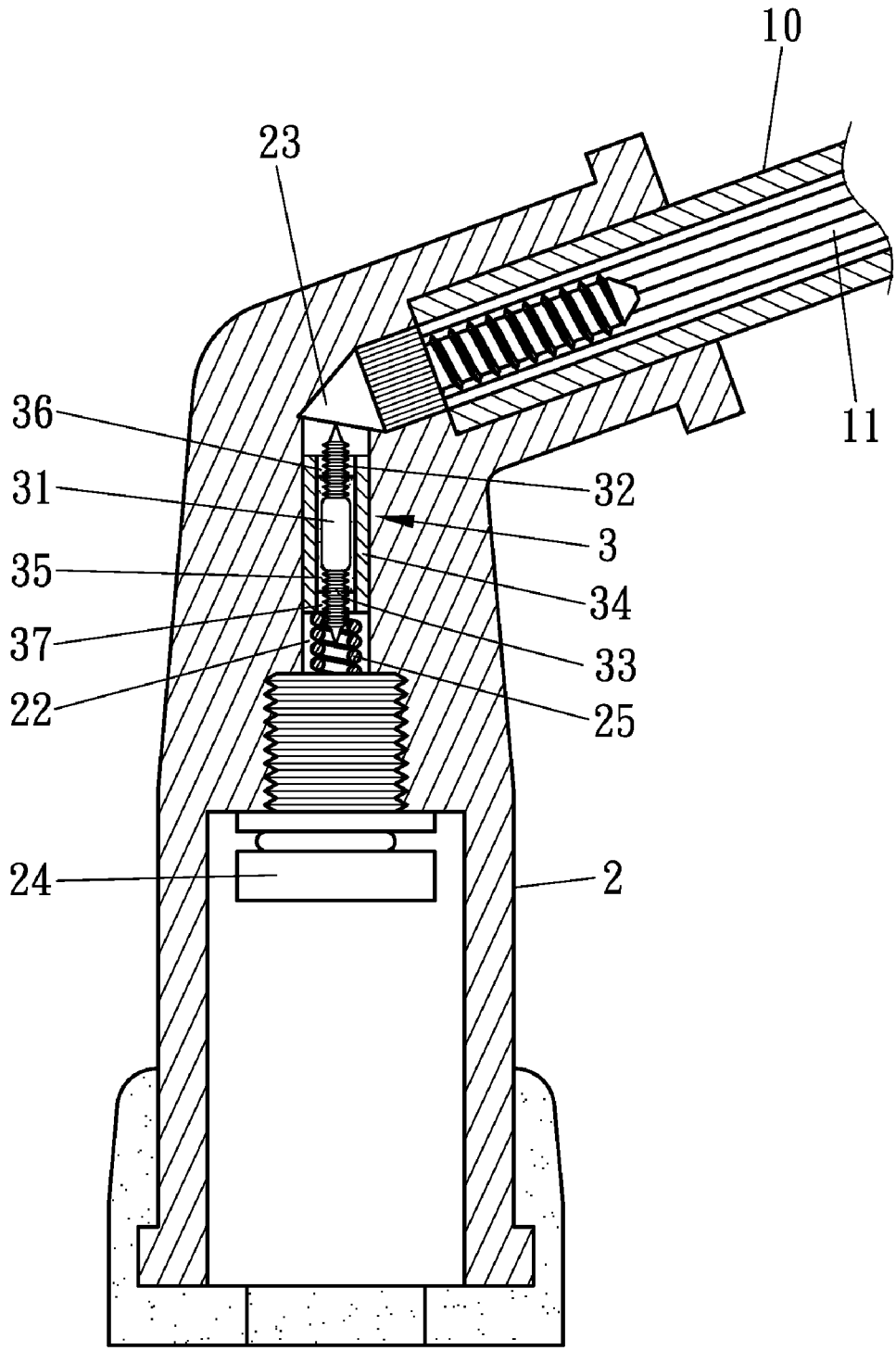
FIG. 3 is a cross-sectional view of a second preferred embodiment of an ignition enhancer for a vehicle engine in the present invention, showing it being used.

Next, FIG. 3 shows a second preferred embodiment of an ignition enhancer 3 for a vehicle engine in the present invention. The plug connector 2 is provided with an accommodating chamber 22 used to install the ignition enhancer 3 therein, a wire connecting rod 23 connected with one end of the accommodating chamber 22, a connecting head 24 connected with the other end of the accommodating chamber 22, and a spring 25 mounted around a top of the connecting head 24. Accordingly, the conducting rods 32 and 33 extend out of two ends of the insulation sleeve 34 respectively, with the conducting rod 32 contacting on the wire connecting rod 23 of the plug connector 2 and the conducting rod 33 connected with the spring 25 on the connecting head 24.

As mentioned previously, with the ignition enhancer 3 installed inside the plug connector 2, the capacitor 31, storing an electric charge, is also able to stabilize voltage and fulfill filtering after starting a vehicle engine, not only advancing combustion efficiency to lower carbonization and augment engine power but also lessening emission of polluting gases as well.

Figure 4:
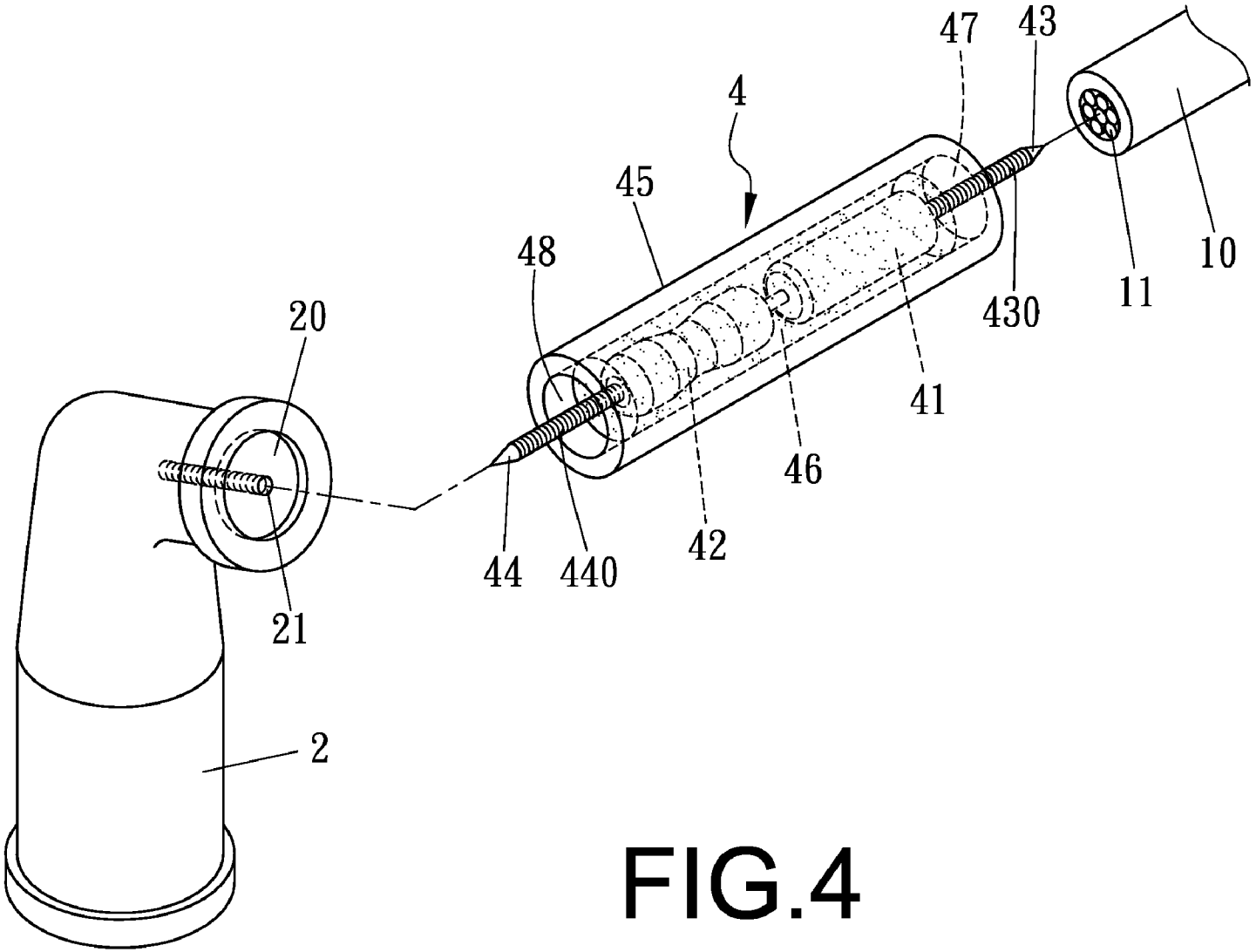
FIG. 4 is an exploded perspective view of a third preferred embodiment of an ignition enhancer for a vehicle engine in the present invention.
Figure 5:
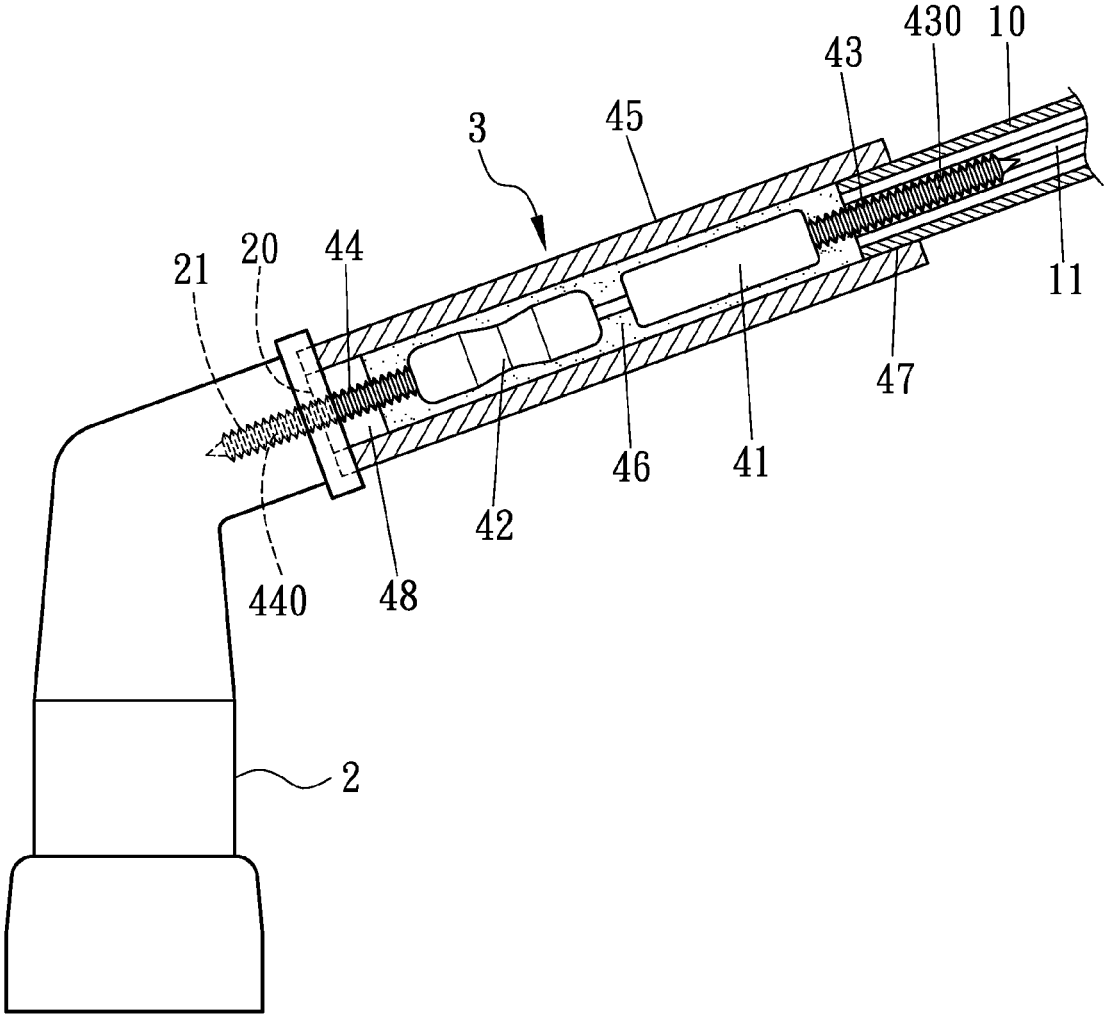
FIG. 5 is a cross-sectional view of the third preferred embodiment of an ignition enhancer for a vehicle engine in the present invention.

FIGS. 4 and 5 show a third preferred embodiment of an ignition enhancer 4 for a vehicle engine in the present invention. The ignition enhancer 4 is installed between a conducting wire 10 of a high voltage coil and a plug connector 2. The ignition enhancer 4 is provided with a capacitor 41 and an inductance 42 connected in series, two conducting rods 43 and 44 respectively extended outward from two ends, an insulation sleeve 45 wrapping around the capacitor 41 and the inductance 42 and filled with waterproof resin 46 (Epoxy resin) to fully surround the capacitor and the inductance 42, and two engaging grooves 47 and 48 respectively formed in two ends of the insulation sleeve 45. Each of the conducting rods 43 and 44 has male threads 430 and 440 formed around the surface respectively.

In assembling, an end of the conducting wire 10 of the high voltage coil is first plugged in the engaging groove 47 of the ignition enhancer 4, with the conducting rod 43 inserted into a core 11 of the conducting wire 10, and the other end of the ignition enhancer 4 is plugged into the groove 20 of the plug 2, with the conducting rod 44 threadably engaging with the female-threaded hole 21. Thus, with the ignition enhancer 4 connected between the conducting wire 10 of the high voltage coil of a vehicle engine and the plug connector 2, the capacitor 41, storing an electric charge, is able to stabilize voltage and fulfill filtering, and the inductance 42 is able to alter power to strengthen electric power after starting a vehicle engine, not only advancing combustion efficiency to lower carbonization and augment engine power but also lessening emission of polluting gases at the same time.

While the preferred embodiment of the invention has been described above, it will be recognized and understood that various modifications may be made therein and the appended claims are intended to cover all such modifications that may fall within the spirit and scope of the invention.

What is claimed is:

1. An ignition enhancer for a vehicle engine, said ignition enhancer installed between a conducting wire of a high voltage coil and a plug connector and provided with a capacitor, two conducting rods respectively extended outward from two ends of said capacitor, said capacitor wrapped by an insulation sleeve that is filled with waterproof resin to fully surround said capacitor, two engaging grooves respectively formed in two ends of said insulation sleeve.

2. The ignition enhancer for a vehicle engine as claimed in claim 1, wherein said waterproof resin is Epoxy resin.

3. The ignition enhancer for a vehicle engine as claimed in claim 1, wherein each of said conducting rods has male threads formed around its surface.

4. The ignition enhancer for a vehicle engine as claimed in claim 1, wherein said ignition enhancer is installed inside said plug connector.

5. The ignition enhancer for a vehicle engine as claimed in claim 1, wherein said ignition enhance is provided with an inductance and a capacitor that are connected in series.

* * * * *